US012330835B1

(12) United States Patent
Peer

(10) Patent No.: US 12,330,835 B1
(45) Date of Patent: Jun. 17, 2025

(54) MODULAR ACCESSORY-INTEGRATED LIQUID DISPENSER

(71) Applicant: Roy Peer, Brandon, FL (US)

(72) Inventor: Roy Peer, Brandon, FL (US)

( * ) Notice: Subject to any disclaimer, the term of this patent is extended or adjusted under 35 U.S.C. 154(b) by 0 days.

(21) Appl. No.: 18/765,259

(22) Filed: Jul. 6, 2024

Related U.S. Application Data

(60) Provisional application No. 63/569,329, filed on Mar. 25, 2024.

(51) Int. Cl.
*B65D 1/04* (2006.01)
*B65D 21/02* (2006.01)
*B65D 85/62* (2006.01)

(52) U.S. Cl.
CPC ..... *B65D 1/04* (2013.01); *B65D 21/0209* (2013.01); *B65D 85/62* (2013.01)

(58) Field of Classification Search
CPC ..... B65D 1/04; B65D 85/62; B65D 21/0209
See application file for complete search history.

(56) References Cited

U.S. PATENT DOCUMENTS 5,064,073 A * 11/1991 Folland ..... B65D 51/28 229/123.1
5,439,104 A * 8/1995 Wolska-Klis ..... G02C 13/006 221/96
6,431,405 B2 * 8/2002 Irwin ..... A47K 10/32 222/192
8,371,479 B2 * 2/2013 Luft ..... A47L 13/16 239/289
9,010,582 B1 * 4/2015 Atkinson ..... B65D 23/001 206/226
9,365,320 B1 * 6/2016 Erickson ..... B65D 23/001
2009/0090737 A1 * 4/2009 Franco ..... A47K 5/12 221/96
2013/0220849 A1 * 8/2013 McCarthy ..... B65D 83/0805 206/223
2024/0239561 A1 * 7/2024 Orlando ..... B65D 25/56

* cited by examiner

*Primary Examiner* — Nathan J Jenness
*Assistant Examiner* — Jennifer Castriotta
(74) *Attorney, Agent, or Firm* — Barry Choobin; Patent 360

(57) ABSTRACT

An apparatus that includes a main container and one or more additional compartments. The main container can be used to store products like liquid detergent. Products related to that stored in the main container can be provided in the additional compartments. The additional compartments may also have a slit or window for dispensing the respective products.

2 Claims, 4 Drawing Sheets

MODULAR ACCESSORY-INTEGRATED LIQUID DISPENSER

CROSS-REFERENCE TO RELATED APPLICATIONS

This application claims priority from a U.S. Provisional Patent Appl. No. 63/569,329, filed on Mar. 25, 2024, which is incorporated herein by reference in its entirety.

FIELD OF INVENTION

The present invention relates to containers and liquid dispensers, and more particularly, the present invention relates to containers with one or more additional compartments.

BACKGROUND

Containers are an essential part of day-to-day life. Containers are used in storing, packaging, and transporting articles. Different types of containers are used for different types of articles. Containers play a critical role in ascertaining the shelf life of products. Moreover, the container can affect the ease of dispensing the product from the container.

For example, in washing and cleaning tasks, surfactant is used, however, other products are also commonly used. The detergent and other products are available separately in different containers. These additional products or accessories are frequently used with the main product i.e., the detergent. Using different containers while performing one task is often laborious and undesirable to many users.

Therefore, A need is appreciated for container design improvements that can make dispensing different products easy and convenient.

SUMMARY OF THE INVENTION

The following presents a simplified summary of one or more embodiments of the present invention to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of this invention is therefore directed to an apparatus including a main container and additional compartments integral to the main container.

Another object of this invention is that one or more compartments of the additional compartments have dispensing means.

Still, another object of this invention is that the different accessories can be stored in the additional compartment to be used conveniently and easily.

A further object of this invention is that the apparatus reduces the clutter of multiple containers.

Still, a further object of this invention is that the apparatus helps improve the overall user experience.

In one aspect, disclosed is a modular accessory-integrated liquid dispenser designed for versatile use across various environments. The dispenser features a main container for liquid and modular compartments that attach to the main container for storing accessories such as dryer sheets, scent beads, fabric softener pods, or sponges. This design facilitates ease of use, improves organizational efficiency, and reduces the need for separate storage containers for related accessories. One or more of the additional compartments can have a slit for dispensing sheets.

BRIEF DESCRIPTION OF DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Figure 1:
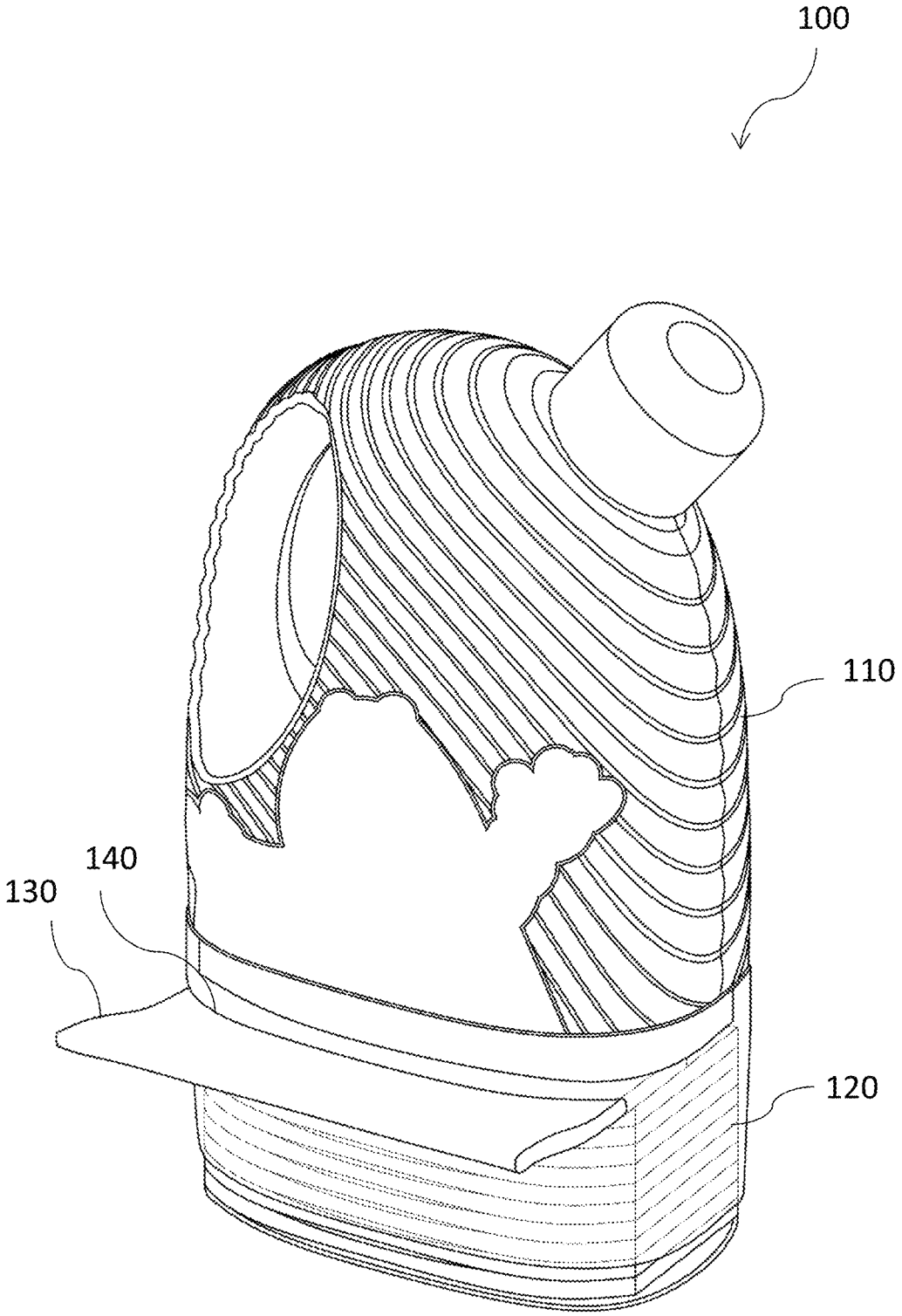
FIG. 1 shows an apparatus having a main container for liquid and an additional compartment for dry sheets, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting to embodiments of the invention. As used herein, the singular forms "a", "an" and "the" are intended to include the plural forms as well, unless the context indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Disclosed is an apparatus having a main container and one or more additional compartments. The main container can be used to store a chief product or ingredient, and one or more additional compartments can be used to store additional products or accessories. Such additional products or accessories can be complementary to the main product in the main container. That is the main product in the main container and the accessories or additional products in the additional compartments can be used for the same task. For example, the main container may include detergent while the additional compartments may contain dry sheets, fragrance beads, conditioner, softener pods, and the like, all are known for use in laundry. Using the disclosed apparatus, different products to be used by a user are within the reach of the user i.e., a user can easily and quickly get any product in the apparatus and does not have to rush here and there to get different products while cleaning or washing.

Referring to FIG. 1 shows apparatus 100 which includes a main container 110 and an additional compartment 120. The main container is implemented in the form of a bottle that can hold liquid laundry detergent. The size and shape of the main container can vary without departing from the scope of the present invention. For example, the main container can be adapted for storing powder detergent. The main container may also include suitable dispensing means, such as a spray head. For use in cleaning purposes, the spray head can dispense the liquid surfactant on a surface. Similarly, any dispensing means, such as metering dispensing means in which a specific quantity of liquid can be dispensed, can be incorporated without departing from the scope of the present invention.

The additional compartment can be coupled to the bottom of the main container. The additional compartment can be used to store dryer sheets 130. The dryer sheets are known in the art for use in laundry during washing. Any such dryer sheet can be stored in the additional compartment without departing from the scope of the present invention. The additional compartment also has a window 140 through which one or more dryer sheets can be pulled out. The dryer sheet can be stacked within the additional compartment and one or more dryer sheets can be pulled out from the stack through the window.

The additional compartment can be coupled to the bottom of the main container. In certain implementations, the additional compartment can be integral to the main container. For example, the main container and the additional compartment can be manufactured as a single unit. Also, the additional compartment can be fixedly coupled to the bottom of the main container. In certain implementation, the additional compartment can also be coupled to the main container using suitable fastening mechanism, such as a snap-fit mechanism, threaded screwing mechanism, and the like. Any such fastening mechanism is within the scope of the present invention.

Figure 2:
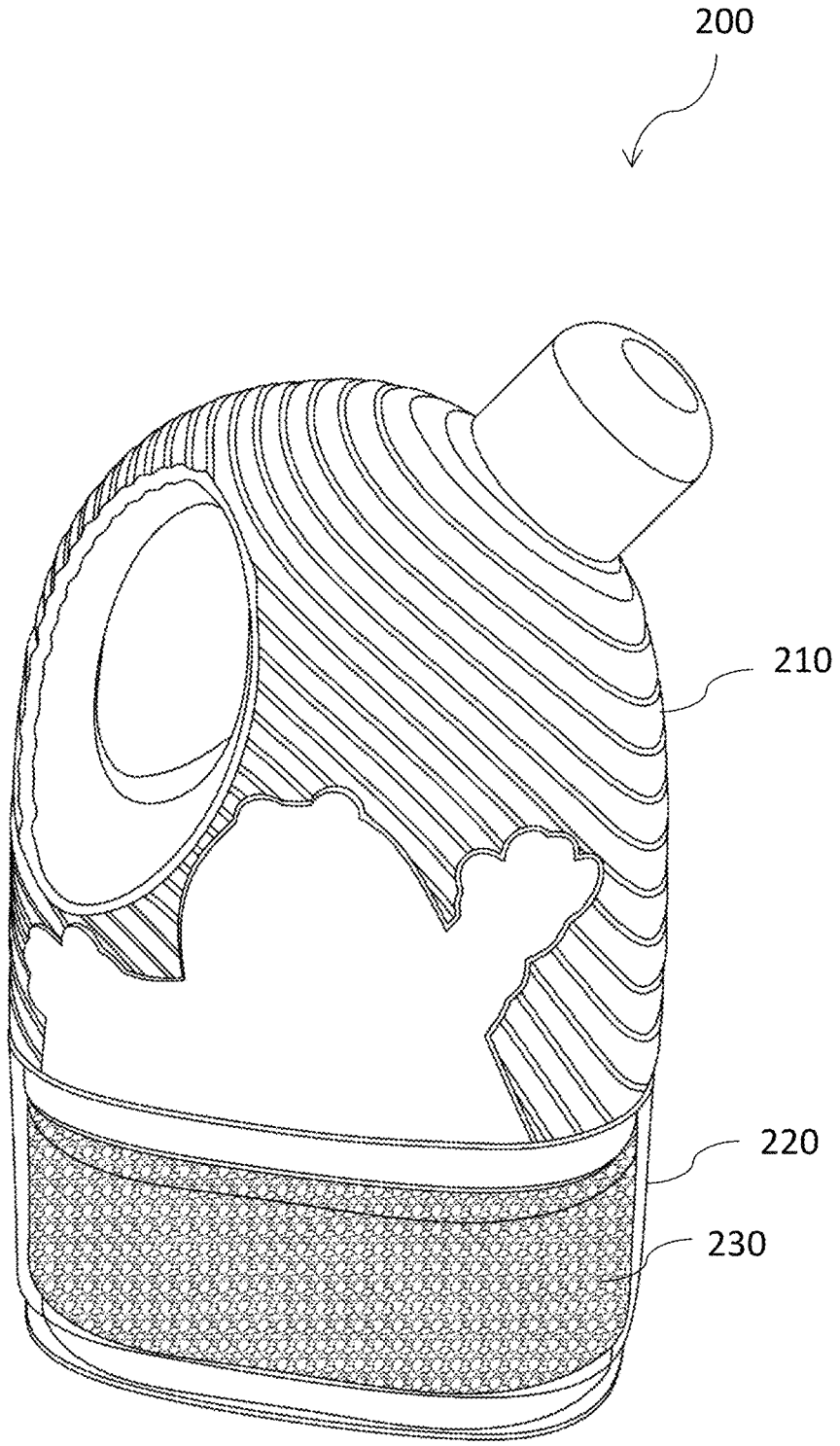
FIG. 2 shows an apparatus having the main container and an additional compartment for scent beads, according to an exemplary embodiment of the present invention.
Figure 3:
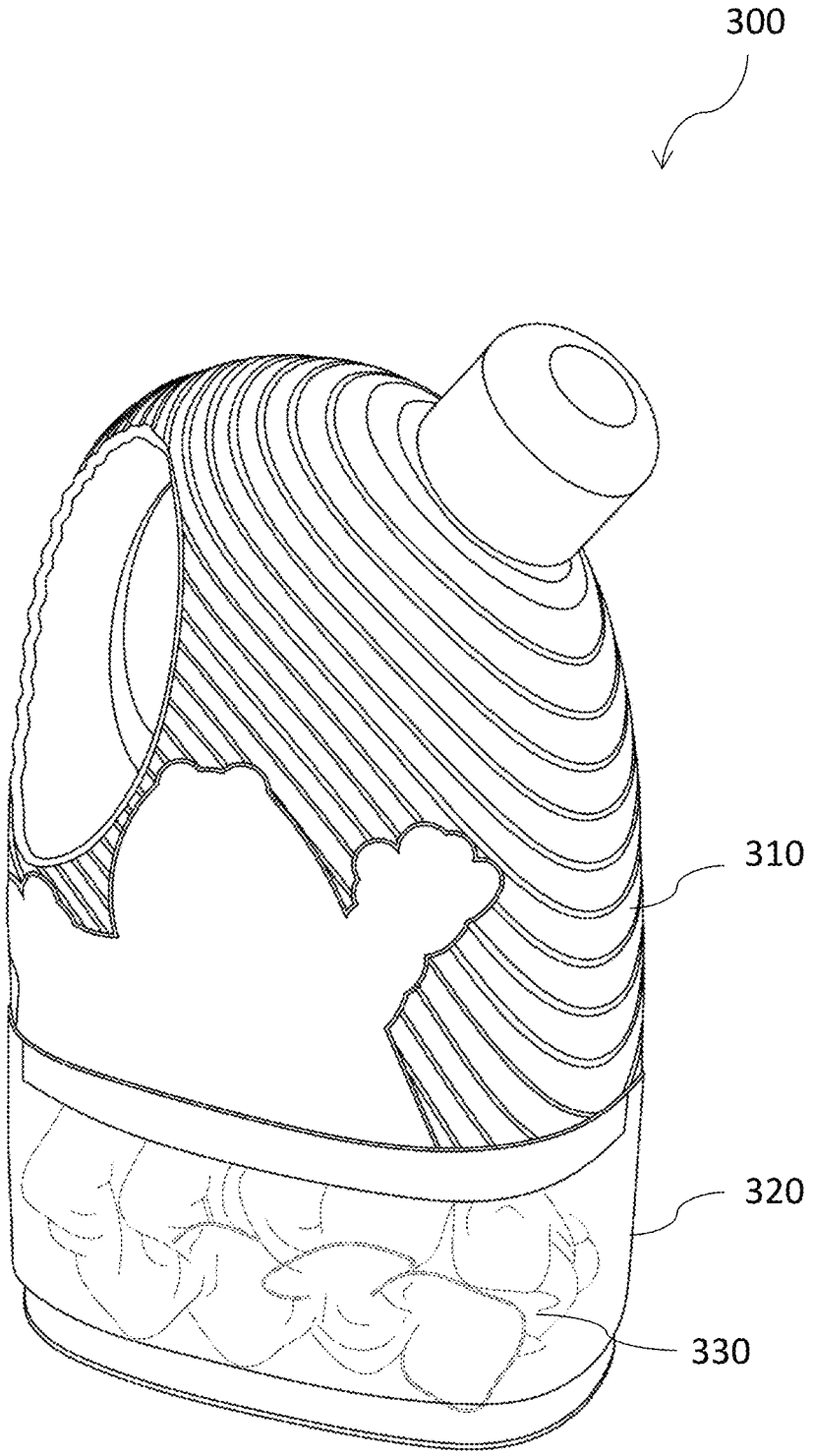
FIG. 3 shows an apparatus having the main container and an additional compartment for softener pods, according to an exemplary embodiment of the present invention.
Figure 4:
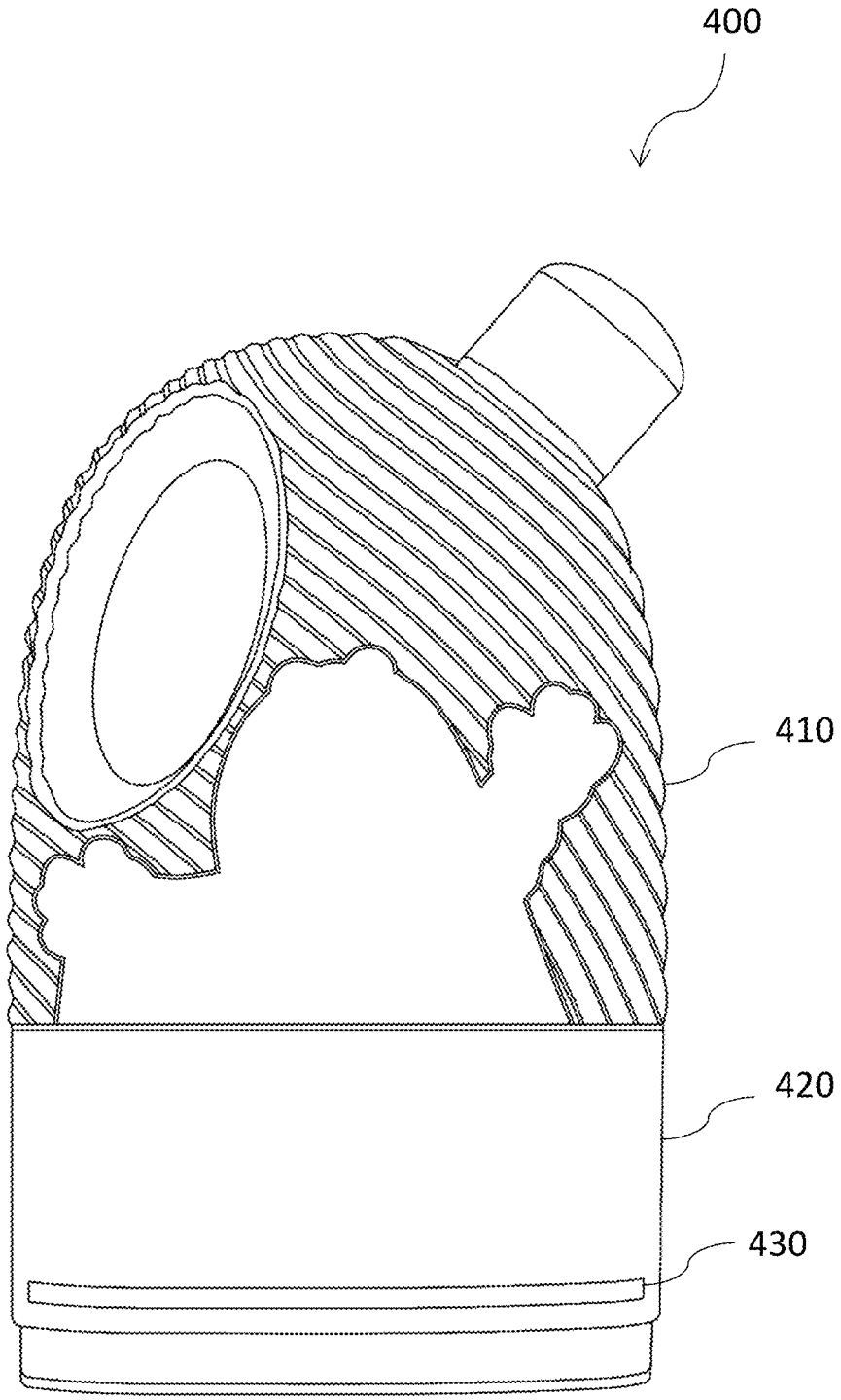
FIG. 4 shows an apparatus having a main container and an additional compartment having a slit for dispensing sheets, according to an exemplary embodiment of the present invention.

It is to be noted that the additional compartment can also be varied for a different utility and any such variation is within the scope of the present invention. For example, FIGS. 2-4 show different types of additional compartments for different purposes. Although the drawings show a single additional compartment, it is to be understood that more than one additional compartment is within the scope of the present invention. For sample, the apparatus may have a main container, a first compartment coupled to the main container, and a second compartment coupled to the first compartment. The first compartment and the second compartment can be the same or different.

In certain implementations, the first compartment can be integral to the main container and the second compartment can be integral to the first compartment. In certain implementations, the first compartment can be integral to the main container and the second compartment can be removably coupled to the first compartment. In certain implementations, the first compartment can be removably coupled to the main container and the second compartment can be integral to the first compartment. In certain implementations, the first compartment is removably coupled to the main container and the second compartment is removable coupled to the first compartment.

FIG. 2 shows another implementation of apparatus 200 in which the main container 210 is the same i.e. a bottle that can contain the liquid laundry detergent. The additional compartment 220 can be adapted for storing the scent beads 230. The scent beads can be used in washing laundry for imparting fragrance to the clothes. The additional compartment can be coupled to the bottom of the main container through a suitable fastening mechanism, such as a snap fit, threaded screw, and the like. The additional compartment can be detached for gaining access to the scent beads.

Referring to FIG. 3 shows another embodiment of apparatus 300 in which the main container 310 is in the shape of a bottle. Liquid detergent can be stored in the main container and the narrow mouth of the bottle shaped main container can be closed using a cap. The additional compartment 320 can be adapted for storing the softener pods 330. The softener pods are known for use in washing laundry. The additional compartment can be coupled to the bottom of the main container through a suitable fastening mechanism, such as a snap fit, threaded screw, and the like. The additional compartment can be detached to gain access to the softener pods.

Referring to FIG. 4 shows another embodiment of apparatus 400 in which the main container 410 is in the shape of a bottle. Liquid detergent can be stored in the main container and the narrow mouth of the bottle-shaped main container can be closed using a cap. Additional compartment 420 can be adapted for storing sheet-like articles, such as dryer sheets. The sheets can be stacked in the additional compartment. An elongated slit 430 can be provided near the bottom of the additional compartment. Through the slit, a sheet can be pulled out one at a time. The additional compartment can be coupled to the bottom of the main container through a suitable fastening mechanism, such as a snap fit, threaded screw, and the like. The additional compartment can be detached to refill the second compartment. The second compartment can also be made integral to the main container.

In certain implementations, the main container can be designed to hold a variety of liquids. The main container may feature an ergonomic pump or spout for dispensing the liquid. One or more additional compartments can be attached to the main container and can be used for different accessories relevant to the liquid product. The attachment mechanism allows for easy customization and interchangeability of the compartments. For example, in-home laundry care, the apparatus may contain laundry detergent and one or more dryer sheets, scent beads, or fabric softener pods, for streamlining the laundry process. In the Kitchen Cleaning Station, the apparatus may include dish soap and one or more sponges, brushes, and steel wool, making dishwashing more organized and efficient. In another example, the apparatus may include shampoo, body wash, or conditioner, while one or more additional compartments may include related items like razors, bath sponges, or hair treatments, simplifying the shower routine.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method for storing related products, the method comprising:

storing a first product in a main container of an apparatus;

storing a second product in a first compartment of the apparatus, wherein the first compartment is mounted to a bottom of the main container, wherein the first product and the second product are different, wherein the first compartment has an open top covered by the bottom of the main container, wherein the first compartment is removably coupled to the main container, wherein the first product is a liquid detergent, and the second product comprises dryer sheets stacked in the first compartment, wherein the first compartment has an elongated slot in a wall of the first compartment for taking out a sheet of the dryer sheets one at a time, wherein the first compartment is coupled to the main container through a fastening mechanism allowing the first compartment to be detached for refilling; and dispensing the second product through the elongated slot.

2. The method of claim 1, wherein the method further comprises:

integrating a second compartment with the first compartment, wherein the second compartment comprises fabric softener pods.

* * * * *